US009039548B2

(12) United States Patent
Sams, III

(10) Patent No.: US 9,039,548 B2
(45) Date of Patent: May 26, 2015

(54) SWING TRAINING DEVICE AND SYSTEM

(71) Applicant: James I. Sams, III, Venetia, PA (US)

(72) Inventor: James I. Sams, III, Venetia, PA (US)

( * ) Notice: Subject to any disclaimer, the term of this patent is extended or adjusted under 35 U.S.C. 154(b) by 130 days.

(21) Appl. No.: 13/732,190

(22) Filed: Dec. 31, 2012

(65) Prior Publication Data

US 2013/0172129 A1 Jul. 4, 2013

Related U.S. Application Data

(60) Provisional application No. 61/582,596, filed on Jan. 3, 2012.

(51) Int. Cl.

| | |
|---|---|
| ***A63B 69/00*** | (2006.01) |
| ***A63B 71/06*** | (2006.01) |
| *A63B 24/00* | (2006.01) |
| *A63B 71/00* | (2006.01) |

(52) U.S. Cl.

CPC ..... *A63B 69/0002* (2013.01); *A63B 69/0079* (2013.01); *A63B 71/0622* (2013.01); *A63B 24/0062* (2013.01); *A63B 2069/0008* (2013.01); *A63B 2071/009* (2013.01); *A63B 2207/02* (2013.01); *A63B 2220/803* (2013.01); *A63B 2220/808* (2013.01); *A63B 2225/50* (2013.01)

(58) Field of Classification Search

USPC ..... 473/426, 422, 451, 453, 457, 458; 482/83, 86, 89; 607/108

See application file for complete search history.

(56) References Cited

U.S. PATENT DOCUMENTS

| | | | | |
|---|---|---|---|---|
| 5,321,593 | A * | 6/1994 | Moates | 362/249.05 |
| 5,788,582 | A * | 8/1998 | Shapiro | 473/220 |
| 5,833,549 | A * | 11/1998 | Zur et al. | 473/199 |
| 5,964,668 | A * | 10/1999 | Tai et al. | 473/220 |
| 6,095,661 | A * | 8/2000 | Lebens et al. | 362/184 |
| 6,502,319 | B1 * | 1/2003 | Goodrich et al. | 33/286 |
| 6,770,002 | B2 * | 8/2004 | Aigotti | 473/457 |
| 6,855,921 | B1 * | 2/2005 | Stopperan et al. | 250/221 |
| 7,300,388 | B2 * | 11/2007 | Sams, III | 482/89 |
| 8,100,532 | B2 * | 1/2012 | Yoo et al. | 351/209 |
| 8,292,760 | B2 * | 10/2012 | Johnson | 473/450 |
| 2005/0107180 | A1 * | 5/2005 | Halleck et al. | 473/220 |
| 2005/0157389 | A1 * | 7/2005 | Shipman et al. | 359/529 |
| 2010/0309391 | A1 * | 12/2010 | Plut | 348/756 |
| 2012/0040768 | A1 * | 2/2012 | Allen et al. | 473/157 |
| 2012/0277015 | A1 * | 11/2012 | Boyd et al. | 473/223 |
| 2013/0172129 | A1 * | 7/2013 | Sams, III | 473/417 |

FOREIGN PATENT DOCUMENTS

| | | | | |
|---|---|---|---|---|
| CA | 2088834 | * | 2/1993 | A63B 69/00 |

* cited by examiner

*Primary Examiner* — Gene Kim
*Assistant Examiner* — M Chambers
(74) *Attorney, Agent, or Firm* — Gary P. Topolosky

(57) ABSTRACT

A swing training device and system that includes a sequence of LED lights that are used to simulate the movement of a pitched ball along a horizontal line and act as a cue for initiating a swing. The swing training device will help develop visual skills by using the eyes to track a light source along a path to the ball such that a bat or striking object hits the ball at the same time the moving light intersects or passes over the ball. The light carrying cable is of a durable design so that the user may practice with the game used bat.

17 Claims, 3 Drawing Sheets

SWING TRAINING DEVICE AND SYSTEM

CROSS REFERENCE TO RELATED APPLICATION

The present application claims priority to U.S. Provisional Application Application No. 61/582,596 e-filed on Jan. 3, 2012.

The present application presents an improvement to Sams U.S. Pat. No. 7,300,388.

TECHNICAL FIELD

The present disclosure is directed generally to systems and methods for developing and training the proper swing mechanics of a baseball or softball player by using a cue to initiate a timely swing.

SUMMARY OF THE INVENTION

This invention relates an improvement to my earlier U.S. Pat. No. 7,300,388 for swing training in which a line configuration was claimed to support a ball assembly and also simulate a visual path or track that a ball would travel from pitcher to batter.

The present invention is a swing training device and system that also develops eye movement and tracking skills used to strike or hit a moving object with a bat, stick or racket. The training device proposed here will provide a more realistic practice experience to users of swing trainers in a manner that simulates those skills used to hit a pitched baseball or softball by conditioning the eyes to track and time a moving light source which illuminates the line configuration claimed in U.S. Pat. No. 7,300,388. This invention now provides a cue to the hitter in a training opportunity designed to consistently swing a bat on time. A moving light serves as the cue by simulating a pitched ball such that the batter trains to strike a stationary ball when a moving light intersects, leads to, or otherwise provides a path to the stationary ball.

This swing training device will also provide user feedback as to record and display weather the user's swing was early, on-time (i.e., ball was hit at the same time moving light intersected with ball) or late. Timing feedback may be presented as an audible sound, a digital readout, (yellow, red, green lights), digital score or combinations thereof. The feedback information may be stored electronically and/or downloaded to various devices and used to track progress over time for players and coaches. The device may be used with a range of swing trainers designed as a single or multiple ball hitting station that can be configured for a range of situations from home to indoor gym to on field use. A realistic cue provides a new dimension for swing trainers using a stationary ball in which the user develops those timing skills for hitting a pitched ball.

BACKGROUND

A sports training device is used to teach specific skills required for a sport. The device may be used to fine tune and exercise the muscular-skeletal mechanics related to the specific sport. The device may be used to practice and drill specific skills on and off the playing field. At competitions, the device may be used for pre-game warm-up exercises. Training devices generally include mobile or stationary objects used in the specific sport. In baseball or softball, for instance, a training device may include a mobile or stationary baseball, softball or similar object that a user may strike with his or her baseball/softball bat. For tennis, racquetball, squash or badminton, a training device may include a mobile or stationary ball, birdie or other similar object that a user may strike with a racket. For golf, a training device may include a golf ball or similar object that a user may strike with a golf club, and so on.

To enhance the training device, a timing mechanism maybe used to train and develop the hand and eye skills used to track and time a moving object such as a baseball or softball. This proposed training device added to such devices as a batting tee, elastic-cord swing trainers, soft-toss machines, etc., can help make the experience more realistic providing a cue of when to swing.

Because a user may want to practice in different locations such as at home, at the gym, at a practice field, and/or during game competition, it may be desirable for the training device to be transportable. Furthermore, to enhance the learning experience, it may be desirable for the training device to provide feedback to the user. Feedback allows the user to make physiological adjustments and mechanical corrections. Feedback can also reduce the length of time required to learn or master a skill for a particular sport. The swing quality can be measured and recorded through the use of electronic devices and monitors. The recorded feedback can then be stored and transmitted to other devices to monitor swing statistics such as the number of on-time swings versus number of total swings. That information can be used by the players and coaches to track improvements over time.

DETAILED DESCRIPTION

Figure 1:
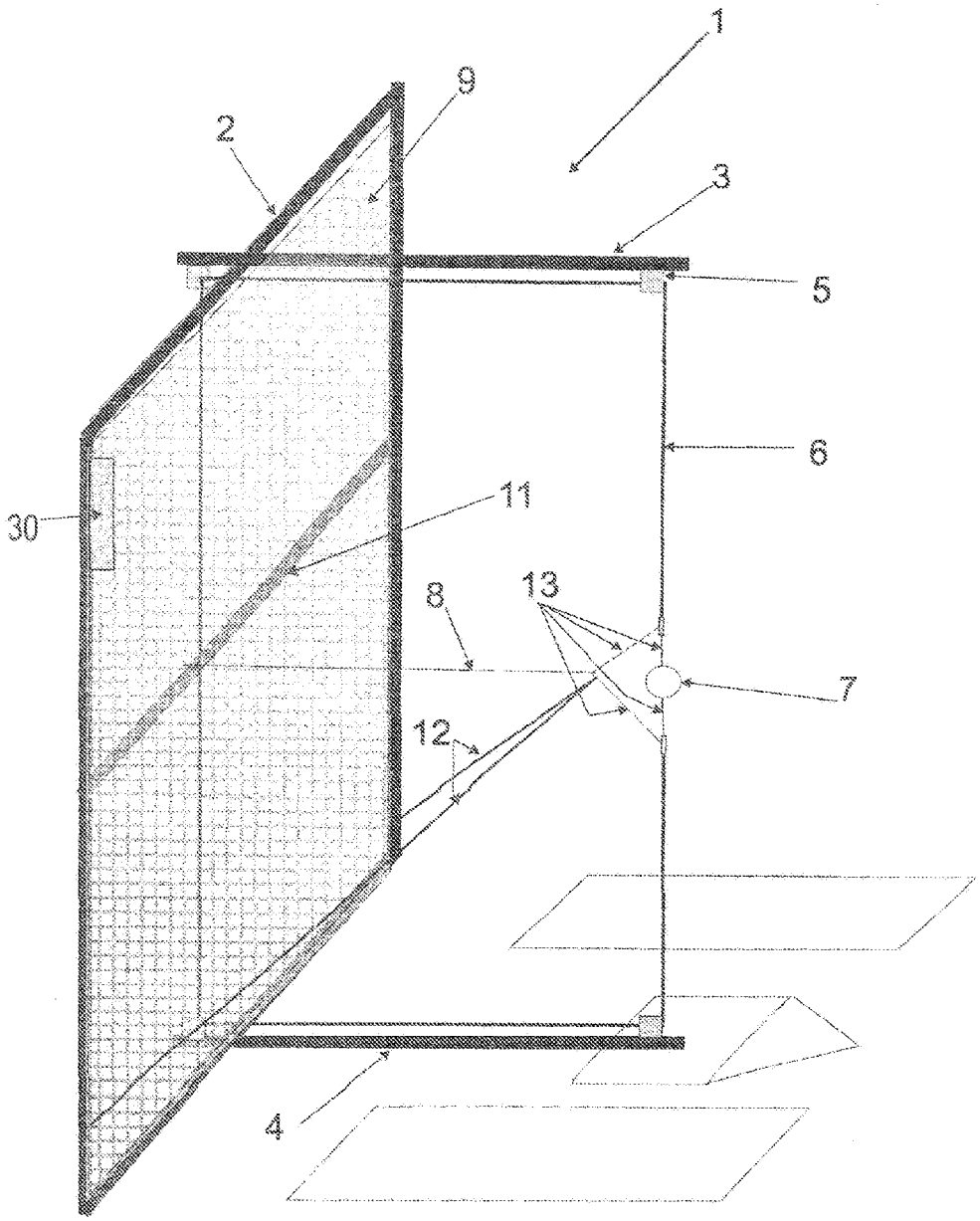
FIG. 1 is a side perspective view of one embodiment of a single station, swing training apparatus from Sams U.S. Pat. No. 7,300,388 to which may be added the swing training device and system according to the present invention.

Referring to FIG. 1 is a perspective view of a baseball practice device for repetitive batting practice using a ball and elastic-cord system. The practice device shown in FIG. 1 reference 1 is similar to the device claimed and patented in Sams U.S. Pat. No. 7,300,388. The V line configuration 13 and single anchor line 8 as claimed and patented in Sams U.S. Pat. No. 7,300,388 serves two purposes: the first is to control and stabilize the ball after bat contact. The second was an attempt to provide a visual conditioning mechanism for training the user to track the flight of a ball with every practice swing by moving his/her eyes along line 8. The single anchor line provides a path for the hitter to visualize the flight track of the pitched ball. The mechanics of hitting and making contact with the ball involves seeing the ball along its flight track. This conditioning allows skilled hitters to visualize a path by viewing points along the line of directional movement. By this process, one may better determine the location, direction, and speed of a particular moving object. The current invention of a swing training device presented here with a moving light source, traversing line 8, provides a cue to the batter of when to swing thus making this swing training experience substantially more realistic through simulating the forward motion of a thrown object like a baseball or softball.

Continuing with reference to FIG. 1, one embodiment of swing training apparatus 1 comprises a rigid rectangular frame 2 and an object assembly 13 operatively coupled to ball 7. The proximate end of Line 8 is operatively coupled to the object assembly 13, wherein the distal end of line 8 passes through net 9 and is operatively coupled to an anchoring strap 11 attached to frame 2. A second V shaped line 12 as claimed and patented in Sams U.S. Pat. No. 7,300,388 is operatively coupled to the object assembly 13 with opposite ends connected to the rectangular frame 2. In further detail, FIG. 1 shows the rectangular frame 2 attached to an upper arm 3 and lower arm 4 which contain pulley wheels 5 through which an elastic-cord 6 freely moves. The object assembly 13 with ball 7 is attached to stretch cord 6. The upper arm 3 and lower arm 4 are substantially horizontal.

Figure 2:
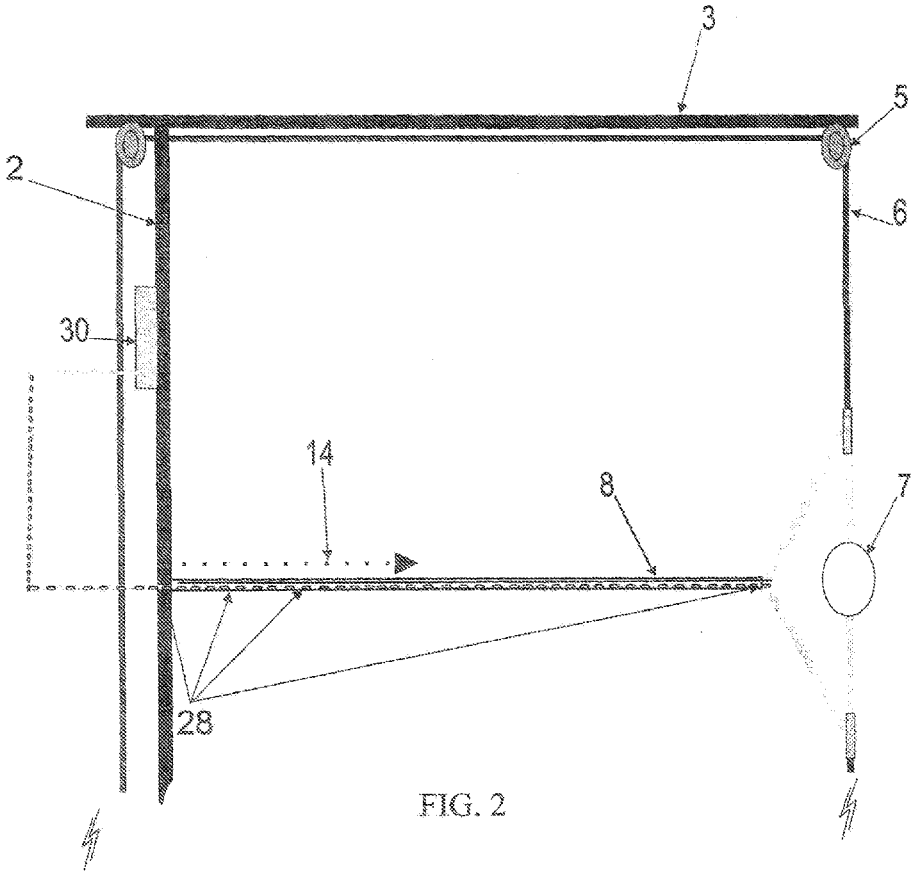
FIG. 2 is a side plan view of the apparatus from FIG. 1 to which has been added one embodiment of a swing training device, a cable consisting of a series of Light Emitting Diodes (LED's) in a durable construction and designed to illuminate a line or path leading to a ball, to serve as a cue to swing by conveying the idea of a moving object such as a pitched baseball or softball according to the present invention.

Referring to FIG. 2, wherein the improvement presented here, in which the structure of line 8 from Sams U.S. Pat. No. 7,300,388 has been modified to a multi-part resilient cable containing LED lights connected by electric wiring such that the cable and LED lights may withstand the flex and tension created by repetitively hitting a baseball in a elastic-cord swing training system. One embodiment of the swing training device and system consists of a sequence of LED lights 28 such that the lights are sequentially timed in the direction of path 14 to simulate a moving object such as a pitched baseball or softball. The LED lights 28 are operatively coupled and controlled by the computing device 30 such that the lighting pattern and timing of the LED lights are in a manner as to create a speed adjustable forward moving LED lighting sequence along the length of line 8 in which the lighted LED progressively advances from the computing device 30 to the object assembly 13.

Figure 3:
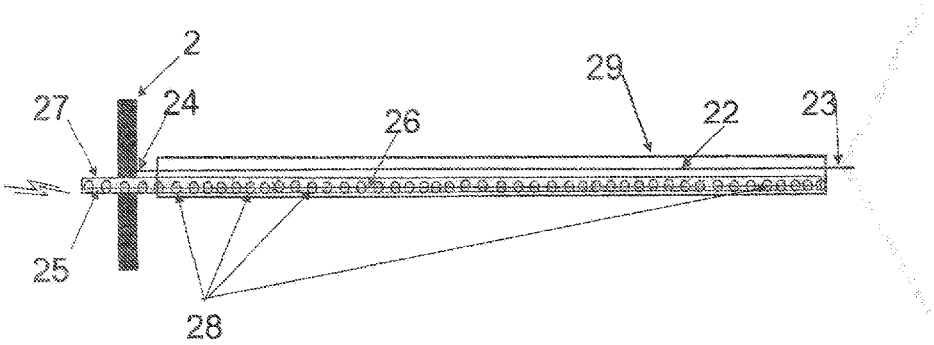
FIG. 3 is a side plan view of the apparatus from FIG. 2 which show greater detail for the components' of the LED cable so designed to be shock resistant through repetitive hitting of a baseball or softball while using the game bat. The cable is subjected to stress and strain as the ball is propelled forward and then catapulted back to the starting point through the action of the elastic cords.

Referring now to FIG. 3, the multi-part cable is shown in more detail. The cable consisting of a substantially transparent, flexible, durable braided outer sleeve 29 designed to bind all inner elements of the multi-part assembly. A main tension bearing line 22 is beneath the outer sleeve 29 and operatively coupled at the proximate end 23 to the object assembly 13 and at the distal end 24 to strap 11 (FIG. 1) which is attached to frame 2. An inner sleeve 27 in the design of a polymeric tube, substantially transparent, flexible and resilient, serves to separate the main tension bearing line 22 from the LED lights 28. The LED lights 28 are connected by electrical fibers 26. A void filling material 25, substantially decreases void space around the LED lights 28 and electric fibers 26 which substantially increases the resiliency of the LED lights 28 and electric fibers 26 by absorbing the shock resulting from hitting the ball and the corresponding tension placed on the entire assembly during the rebound process as the ball returns to its set position. The distal end of the inner sleeve 27 and all the elements therein pass through frame 2 as shown in FIG. 2 to terminate in a computing device 30 (FIG. 2).

Figure 4:
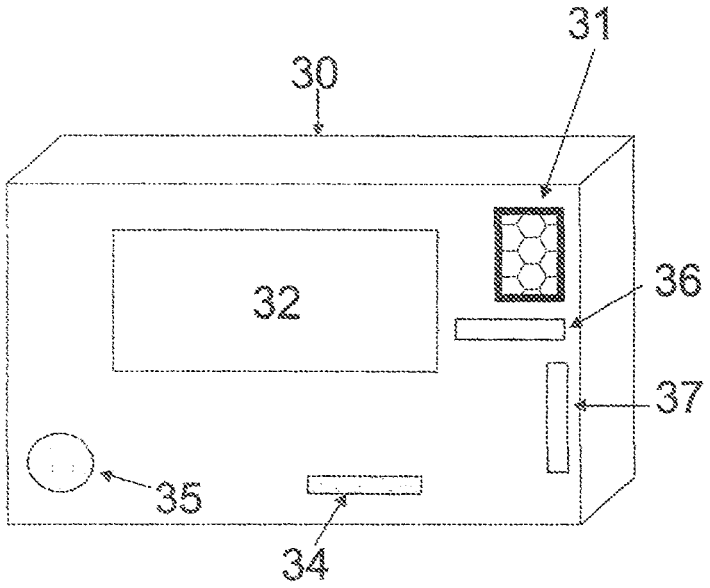
FIG. 4 is a perspective view of the swing training device computer/controller showing several component parts in detail.

With reference to FIG. 4, a preferred embodiment of the swing training device and system includes a computing device 30 with micro-processor 31 that is programmable to control the lighting pattern and timing of the LED lights 28 (FIG. 2) in a manner as to create a speed adjustable forward moving LED lighting sequence 14 in which the lighted LED progressively advances from the computing device 30 to the proximate end of line 22 (FIG. 3). The computing device 30 contains a speed adjustment means 35 to control the forward speed of the lighted LED. The computing device 30 is operatively connected to a sensor 36 for detecting sound or motion in a manner to record the striking contact of the ball 7, wherein the computing means is programmable to record a measurement of the elapsed time from the lighting of the first LED near the control unit to the detected contact. Wherein, the performance goal is to hit the ball when the last LED is lighted near location 23. This would be considered as an on-time swing which represents the skill needed to hit a pitched baseball or softball. A swing that is too early or too late will result in missing the ball or no-contact. Continuing with FIG. 4, the computing device 30 contains a display means 32 for showing a calculated index of performance, wherein the computing device 30 is programmable to display a performance index of swing timing in milliseconds representing how early or late contact with ball 7 was detected in reference to the lighting of the last LED.

Continuing with FIG. 4, results from a practice session would be stored in a data storage module 36, FIG. 4, where the data could then be transferred through hardwire or wireless communication modules 37 to electronic devices such as PDA's or smart phones for further analysis. One such use of this information would be for tracking swing improvement over time as measured by an increase in the frequency of practice swings that are "on-time".

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

REFERENCES FOR PRIOR ART http://www.goole.com/patents/US5833549?dq=swing+and+reaction+time&ei=-hs1UND1HeXk0QGgqoGQCg
http://www.goole.com/patents/US6855921?dq=swing+and+reaction+time&ei=-hs1UND1HeXk0QGgqoGQCg
http://www.goole.com/patents/US5071122?dq=swing+and+reaction+time&ei=zR01UI30PMbx0gGy84GgBA
http://www.google.com/patents?id=avc3AAAAEBAJ&pg=PA2&dq=swing+and+reaction+time&source=gbs_selected_pages&cad=4#v=onepage&q&f=false
http://www.goole.com/patents/EP0562196A1?cl=en&ds=baseball+swing+reaction+time&hl=en&sa=X&ei=HTO1UL6nNPPK0AG97oHIDg&ved=0CDoQ6AEwAQ
http://www.google.com/patents/US8292760?dq=baseball+tracking&hl=en&sa=X&ei=xEKqUKCeLuXV0QGq5GqBA&ved=0CDoQ6AEwAQ
http://www.google.com/patents/US8100532?pg=PA12&dq=baseball+visual+tracking&hl=en&sa=X&ei=GkeqUO31MK2t0AGAm4H4DA&ved=0CE8Q6AEwCA#v=onepage&q=baseball%20visual%20tracking&f=false

The invention claimed is:

1. In a swing training device consisting of:

a first horizontal member having a proximate end and a distal end, the distal end adapted for attaching to a substantially rigid frame;

an object assembly comprising an object located below the proximate end of the first horizontal member;

a first line having a first segment extending substantially along a vertical axis defined through a center of the object assembly and coupled to the proximate end of the first horizontal member, the first line having a second segment extending substantially along the vertical axis below the object assembly and coupled to the proximate end of second substantially rigid horizontal member, wherein the distal end is attached to the substantially rigid frame, the first line having a first end coupled to a top side of the object assembly and a second end coupled to a bottom side of the object assembly;

a second line that extends substantially perpendicular to the first line in a longitudinal direction substantially along a path of the object defining a horizontal axis, the second line having a proximate end coupled to the object assembly and a distal end coupled to a third substantially rigid member operatively connected to the sides of the rigid frame;

a V-shaped third line having a first end, a second end, and a cusp there between, the V-shaped third line being located substantially in the vertical plane, the first end of the third line is coupled to the first end of the first line, the second end of the third line is coupled to the second end of the first line, and the cusp is coupled to the proximate end of the second line; wherein the vertical axis defined through the centerline of the object assembly and the horizontal axis define a vertical plane, the object assembly having a vertical bore that extends through the vertical axis and a fourth line located through the bore, the fourth line having a first end extending above the object and a second end extending below the object;

a V-shaped fifth line having a first end coupled to the left side of the substantially rigid frame, a second end coupled to the right side of the substantially rigid frame, and at a cusp, the V-shaped fifth line being coupled to the cusp of the V-shaped third line;

the improvement which comprises a structurally modified second line formed into a resilient cable system designed to propagate a visual signal along its length so as to create a cue for the batter to initiate a swing wherein contact with the object of the object assembly occurs at the same time the visual signal reaches the object assembly and wherein the visual signal of the resilient cable consists of a series of spaced apart, Light Emitting Diodes (LED's) that are electrically connected for lighting in a manner that will create a cue for initiating a swing to contact the object of the object assembly.

2. The improvement of claim 1 wherein the resilient cable system consists of:

a durable, substantially transparent and flexible outer sheath;

a main tension-bearing fiber having a proximate end coupled to the object assembly and a distal end coupled to a third substantially rigid member;

a substantially transparent inner sheath, designed to provide separation from the main tension-bearing fiber;

electric fibers contained in the inner sheath for connecting a plurality of equally spaced Light Emitting Diodes (LED's) along the length of the second line; and a void filling material for reducing space between the LED's and the inner sheath and for absorbing shock and impact from hitting the object assembly.

3. The improvement of claim 2, wherein the inner sheath extends beyond the distal end of the main tension-bearing fiber and operatively connects to a control unit.

4. The improvement of claim 3, wherein the control unit contains a computing means that is programmable to control the pattern and timing of the LED lights and to create a speed adjustable, forward moving LED lighting sequence along the length of the second line in which the lighted LED progressively advances from the control unit to the object assembly.

5. The improvement of claim 4, wherein the control unit contains means for a user to control the speed at which the lighted LED advances to the object assembly.

6. The improvement of claim 3, wherein the control unit is operatively connected to means for detecting sound or motion so as to record a striking contact with the object.

7. The improvement of claim 6, wherein the control unit includes computing means that is programmable to record a measurement of elapsed time from the lighting of the LED nearest the control unit to the detected contact with the object.

8. The improvement of claim 7, wherein a desired performance goal is the swing event in which contact with the object is detected at about the same time the last LED is lighted at the proximate end of the second line.

9. The improvement of claim 7, wherein the computing means is programmable to display a performance index of swing timing in milliseconds representing how early or late contact with the object was detected with reference to the lighting of the last LED.

10. The improvement of claim 7, wherein the computing means is programmable to show a performance index representing a measured distance for how early or late contact with the object was detected with reference to the lighting of the last LED, through the lighting of an LED positioned at the measured distance from the last LED.

11. The improvement of claim 7 wherein the control unit is connected to wireless means for transmitting performance index data to a receiving device for data analysis.

12. The improvement of claim 7 wherein the computing means is programmable to continue the cycle of a forward moving LED lighting sequence wherein the lighted LED advances to the object and a swing performance index is calculated when contact with the object is detected.

13. The improvement of claim 6, wherein the control unit further contains a display means for showing a calculated index of performance.

14. The improvement of claim 1, wherein the equipment used to strike the object may be the same as those used in playing the physical game.

15. The improvement of claim 14 wherein the equipment is a baseball bat.

16. The improvement of claim 1 wherein the first line is formed of elastic fibers and the second line is formed of non-elastic fibers.

17. The improvement of claim 1 wherein the resilient cable system is constructed to withstand the repeated flex and extension of the second line for allowing the object to be propelled to the frame after being hit and the corresponding tension created as the object rapidly rebounds to its original position through elastic properties of the first line.

* * * * *